US011332929B2

(12) United States Patent
Zhou et al.

(10) Patent No.: US 11,332,929 B2
(45) Date of Patent: May 17, 2022

(54) LARGE-ANGLE SLOPING ROOF STEEL STRUCTURE AND CONSTRUCTION METHOD THEREOF

(71) Applicants: CHINA CONSTRUCTION FIRST DIVISION GROUP CONSTRUCTION & DEVELOPMENT CO., LTD., Beijing (CN); CHINA STATE CONSTRUCTION ENGINEERING CORPORATION LIMITED, Beijing (CN); China construction first group corporation limited, Beijing (CN)

(72) Inventors: Yuqi Zhou, Beijing (CN); Gang Xue, Beijing (CN); Honghai Li, Beijing (CN); Ganglin Liao, Beijing (CN); Qiang Liu, Beijing (CN); Zuojiang Lin, Beijing (CN); Yiqing Zhang, Beijing (CN); Yu Song, Beijing (CN); Hongyuan Wang, Beijing (CN); Le Zhou, Beijing (CN)

( * ) Notice: Subject to any disclaimer, the term of this patent is extended or adjusted under 35 U.S.C. 154(b) by 0 days.

(21) Appl. No.: 17/054,842

(22) PCT Filed: Apr. 16, 2019

(86) PCT No.: PCT/CN2019/082827

§ 371 (c)(1),
(2) Date: Nov. 12, 2020

(87) PCT Pub. No.: WO2019/237823

PCT Pub. Date: Dec. 19, 2019

(65) Prior Publication Data

US 2021/0214939 A1 Jul. 15, 2021

(30) Foreign Application Priority Data

Jun. 11, 2018 (CN) ..... 201810595019.3

(51) Int. Cl.
*E04B 7/02* (2006.01)
*E04B 1/19* (2006.01)
(Continued)

(52) U.S. Cl.
CPC ..... *E04B 7/028* (2013.01); *E04B 1/19* (2013.01); *E04B 1/24* (2013.01); *E04B 7/063* (2013.01);
(Continued)

(58) Field of Classification Search
None
See application file for complete search history.

(56) References Cited

U.S. PATENT DOCUMENTS

2005/0252149 A1* 11/2005 Ritchey ..... E04B 7/06 52/648.1
2006/0032178 A1* 2/2006 Jensen ..... E04B 1/19 52/633
2010/0162635 A1* 7/2010 Kopp ..... E04B 7/028 52/79.4

FOREIGN PATENT DOCUMENTS

CN 102296858 A 12/2011
CN 105464213 A 4/2016
(Continued)

OTHER PUBLICATIONS

Internation Search Report of PCT/CN2019/082827, dated Jul. 10, 2019.
Written Opinion of PCT/CN2019/082827, dated Jul. 10, 2019.

*Primary Examiner* — Basil S Katcheves
(74) *Attorney, Agent, or Firm* — W&KIP

(57) ABSTRACT

A large-angle sloping roof steel structure connected to a main body structure, including: an intermediate platform, inclined main supporting steel columns circumferentially connected at four corners of the intermediate platform, constructing steel columns and wind-proof surrounding beam connected between top ends of the inclined main supporting steel columns, where roof purlin are connected between the adjacent inclined main supporting steel columns at intervals. The invention provides a top-down inverted construction method for a large-angle sloping roof with a steel structure as the main structural form. By using the method, the operation safety of an inclined main stressed vertical member during the installation process can be ensured, and the investment of supporting measures is reduced by preferentially installing the intermediate plat-
(Continued)

form, thus effectively ensuring the installation progress, quality and safety of the sloping roof steel structure. The present invention can be widely applied to sloping roof construction.

10 Claims, 5 Drawing Sheets

(51) Int. Cl.
*E04B 1/24* (2006.01)
*E04B 7/06* (2006.01)

(52) U.S. Cl.
CPC ... *E04B 2001/199* (2013.01); *E04B 2001/249* (2013.01)

(56) References Cited

FOREIGN PATENT DOCUMENTS

| | | | |
|---|---|---|---|
| CN | 107419806 | A | 12/2017 |
| JP | H06248769 | A | 9/1994 |

* cited by examiner

LARGE-ANGLE SLOPING ROOF STEEL STRUCTURE AND CONSTRUCTION METHOD THEREOF

CROSS REFERENCE TO RELATED APPLICATIONS

This application is a continuation of International Patent Application No. PCT/CN2019/082827 with a filing date of Apr. 16, 2019, designating the United States, now pending, and further claims priority to Chinese Patent Application No. 201810595019.3, filed on Jun. 11, 2018, the entire content of which is incorporated herein by reference.

TECHNICAL FIELD

The present invention relates to the field of building construction, and in particular to a roof structure and a construction method thereof.

BACKGROUND

At present, with the development of the building field, the diversity and complexity of buildings are gradually reflected. In super high-rise buildings, there are often design schemes of tapered steel structure roof, which has the characteristics of large inclined angle and difficult construction of inclined steel columns. According to the conventional steel structure installation technology, it is necessary to install the inclined steel columns accurately in place. In order to prevent the inclined steel columns from toppling during the installation process, it is necessary to set several steel supports or all-round scaffold inside the structure. As the number of steel columns is generally large, in order to ensure the stability of each steel column after segmentation during installation, a large number of temporary supports or scaffolds need to be put into the construction, with a huge investment of measures and high cost of manpower and material resources. Moreover, after the structure is installed, the temporary supports or scaffolds are not easy to dismantle and transport, and the whole construction period is long and the workload is heavy, and the construction personnel are all working at heights and are prone to danger.

SUMMARY

The purpose of the present invention is to provide a large-angle sloping roof steel structure and a construction method thereof, to solve the technical problems of large investment and waste of manpower and material resources in roof construction support structures and solve the problems of ensuring construction safety and improving construction efficiency.

In order to achieve the above purposes, the present invention adopts the following technical solutions:

A large-angle sloping roof steel structure connected to a main body structure, including: an intermediate platform, inclined main supporting steel columns circumferentially connected at four corners of the intermediate platform, constructing steel columns and wind-proof surrounding beam connected between top ends of the inclined main supporting steel columns, where roof purlins are connected between the adjacent inclined main supporting steel columns at intervals.

The main body of the intermediate platform is a double-layer grid frame, and includes an upper rectangular grid frame and a lower rectangular grid frame arranged in parallel at intervals, and vertical connecting bars and oblique connecting bars connected between the upper rectangular grid frame and the lower rectangular grid frame, where a lateral side of the upper rectangular grid frame is connected with a side bar parallel to the lateral side through a horizontal connecting bar, and where a first diagonal supporting bar is connected between the side bar and a lateral side of the lower rectangular grid frame.

The four corners of the intermediate platform form conical grooves, where an end point of the side bar is an external convex point, and an end point of the lateral side of the upper rectangular grid frame is an internal concave point.

The inclined main supporting steel columns is a spatial three-dimensional structure, and includes two planar triangular trusses and an intermediate inclined chord positioned between the two triangular trusses, where the middle part of the triangular truss is supported at the external convex point of the intermediate platform, and the middle part of the intermediate inclined chord is supported at the internal concave point of the intermediate platform.

The upper rectangular grid frame and the lower rectangular grid frame of the intermediate platform have the same structures, and are rectangular grid-like frame bodies assembled by cross bars and longitudinal bars; where the cross bars and the longitudinal bars are made of section steel, a set of cross bars are uniformly distributed in parallel at intervals, and the longitudinal bars are connected between the cross bars in parallel at intervals; at least one horizontal diagonal bar is horizontally connected in a grid of the upper rectangular grid frame and/or the lower rectangular grid frame; two ends of the horizontal diagonal bar are connected with the corresponding cross bars and/or longitudinal bars through horizontal lug plate.

The wind-proof surrounding beam is an inverted square frustum frame structure and includes an upper wind-proof surrounding beam, a lower wind-proof surrounding beam and a third connecting bar connected between the corners of the upper wind-proof surrounding beam and the lower wind-proof surrounding beam; a cross-shaped bracket is horizontally connected in the frame of the upper wind-proof surrounding beam, where a horizontal reinforcing bar is connected in the grid of the cross-shaped bracket; cross supporting bars are connected between four sides of the wind-proof surrounding beam and the adjacent third connecting bar.

The constructing steel column includes a square frame arranged in parallel above the upper wind-proof surrounding beam and a third diagonal supporting bar connected between the square frame and the upper wind-proof surrounding beam; there are eight third diagonal supporting bars in a radiating shape, where one end of the third diagonal supporting bar is connected to a corner of the square frame, and the other end of the third diagonal supporting bar is connected to an intersection point of the cross-shaped bracket and the upper wind-proof surrounding beam.

The triangular trusses of the inclined main supporting steel columns include an inner chord, an outer chord and a web member connected between the inner chord and the outer chord; top ends of the two inner chord and the intermediate inclined chord converge at a corner of the lower wind-proof surrounding beam; top ends of the two outer chord converge at a corner of the upper wind-proof surrounding beam, and a second connecting bar is horizontally connected between the outer chord and a corner of the lower wind-proof surrounding beam.

A plane supporting frame is connected among the inner chord, the outer chord and the intermediate inclined chord of the inclined main supporting steel columns; the plane supporting frame is a horizontal frame and is located at a conical groove position of the intermediate platform.

A first connecting bar is horizontally connected between the intermediate inclined chord and the inner chord, a second diagonal supporting bar is connected between the intermediate inclined chord and the outer chord, and a horizontal diagonal supporting bar is connected between the intermediate inclined chord and the roof purlin.

The roof purlin includes a set of transverse purlins connected between the inner chords in parallel at intervals and a set of longitudinal purlin connected between the transverse purlins.

A construction method for a large-angle sloping roof steel structure as described, including the following specific steps:

step 1: reserving a supporting embedded part and/or a fastener for constructing a large-angle sloping roof steel structure during the construction of a main body structure.

step 2: installing a temporary frame support on the main body structure.

step 3: installing an intermediate platform on the temporary frame support.

step 4: connecting an inclined main supporting steel column at a corner of the intermediate platform.

step 5: connecting a wind-proof surrounding beam at the top of the inclined main supporting steel columns.

step 6: connecting a constructing steel column above the wind-proof surrounding beam.

step 7: connecting a roof purlin between the inclined main supporting steel columns.

step 8: removing the temporary supporting frame and completing the construction of the large-angle sloping roof steel structure.

In the step 2, the temporary frame support is a three-dimensional frame structure and includes at least four upright posts and a cross beam horizontally connected between the upper and lower ends of the adjacent upright posts; the lower end of the upright post is connected with the main body structure through a supporting embedded part, and the upper end is provided with a limit mast connecting to the intermediate platform; the four limit masts are provided in a group, are arranged at the top of the upright posts symmetrically and are limited at both sides of a lateral side of a lower rectangular grid frame of the intermediate platform; four diagonal supporting bar are connected in a rectangular frame enclosed by the upright post and the cross beam, where the diagonal supporting bar are spliced into a diamond shape, and the ends of the diagonal supporting bars are connected with the corresponding upright post or the cross beam through diagonal supporting bar connecting plate.

The present invention has the following characteristics and beneficial effects compared with the prior art:

The present invention overcomes the defects of difficult construction and high construction cost of the traditional roof, and solves the technical problems of simplifying construction procedures and improving construction efficiency and construction quality.

The large-angle sloping roof steel structure of the present invention has a reasonable structural design and stable stress; due to the special relationship between the intermediate platform and the inclined main supporting steel column, conical grooves are formed at the positions of the four corners of the intermediate platform corresponding to the inclined main supporting steel column, which is convenient for both to fit and connect;

the top of the inclined main supporting steel column converges on the wind-proof surrounding beam, which ensures the strength and stability of the whole structure; each member is connected by connecting bars and diagonal supporting bars to ensure the connection effect; constructing steel columns and roof purlins unify the overall shape of the roof structure and have better integrity.

The invention relates to the installation operation of a super high-rise steel structure building, and provides a top-down inverted construction method for a large-angle sloping roof with a steel structure as the main structural form. Using the method, the operation safety of an inclined main stressed vertical member during the installation process can be ensured, the intermediate platform of the structure itself is used for construction support, and the investment of supporting measures is reduced by preferentially installing the intermediate platform, thus effectively ensuring the installation progress, quality and safety of the sloping roof steel structure, speeding up the construction period and reducing unsafe factors of steel structure installation.

The present invention can be widely applied to sloping roof construction.

BRIEF DESCRIPTION OF DRAWINGS

The present invention will further be described in detail with reference to the accompanying drawings.

Figure 1:
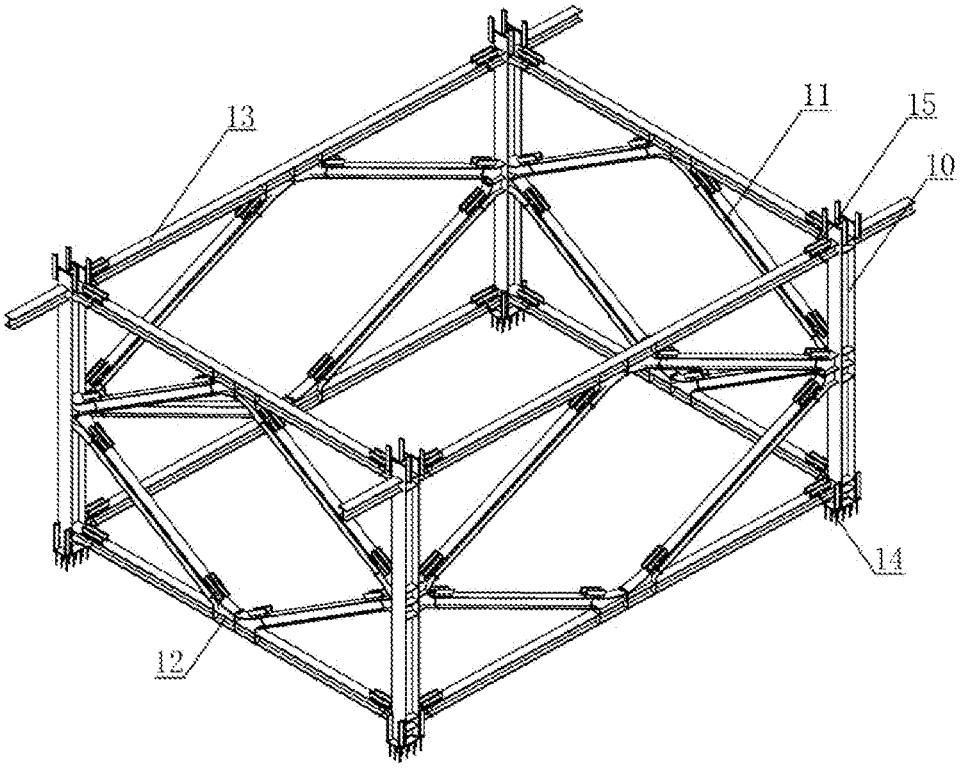
FIG. 1 is a schematic structural diagram of a temporary frame support of the present invention.

Reference numerals: 1—temporary frame support, 10—upright post, 11—diagonal supporting bar, 12—diagonal supporting bar connecting plate, 13—cross beam, 14—supporting embedded part, 15—limit mast; 2—intermediate platform, 20—cross bar, 21—longitudinal bar, 22—horizontal lug plate, 23—horizontal diagonal bar, 24—oblique connecting bar, 25—vertical connecting bar, 26—horizontal connecting bar, 27—side bar, 28—first diagonal supporting bar; 3—inclined main supporting steel column, 30—triangular truss, 31—inner chord, 32—outer chord, 33—intermediate inclined chord, 34—web member, 35—first connecting bar, 36—diagonal supporting bar, 37—plane supporting frame, 38—second diagonal supporting bar, 39—second connecting bar; 4—constructing steel column, 40—square frame, 41—third diagonal supporting bar; 5—wind-proof surrounding beam, 50—upper wind-proof surrounding beam, 51—lower wind-proof surrounding beam, 52—cross supporting bar, 53—cross-shaped bracket, 54—third connecting bar, 55—reinforcing bar; 6—roof purlin, 60—transverse purlin, 61—longitudinal purlin.

DESCRIPTION OF EMBODIMENTS

Figure 5:
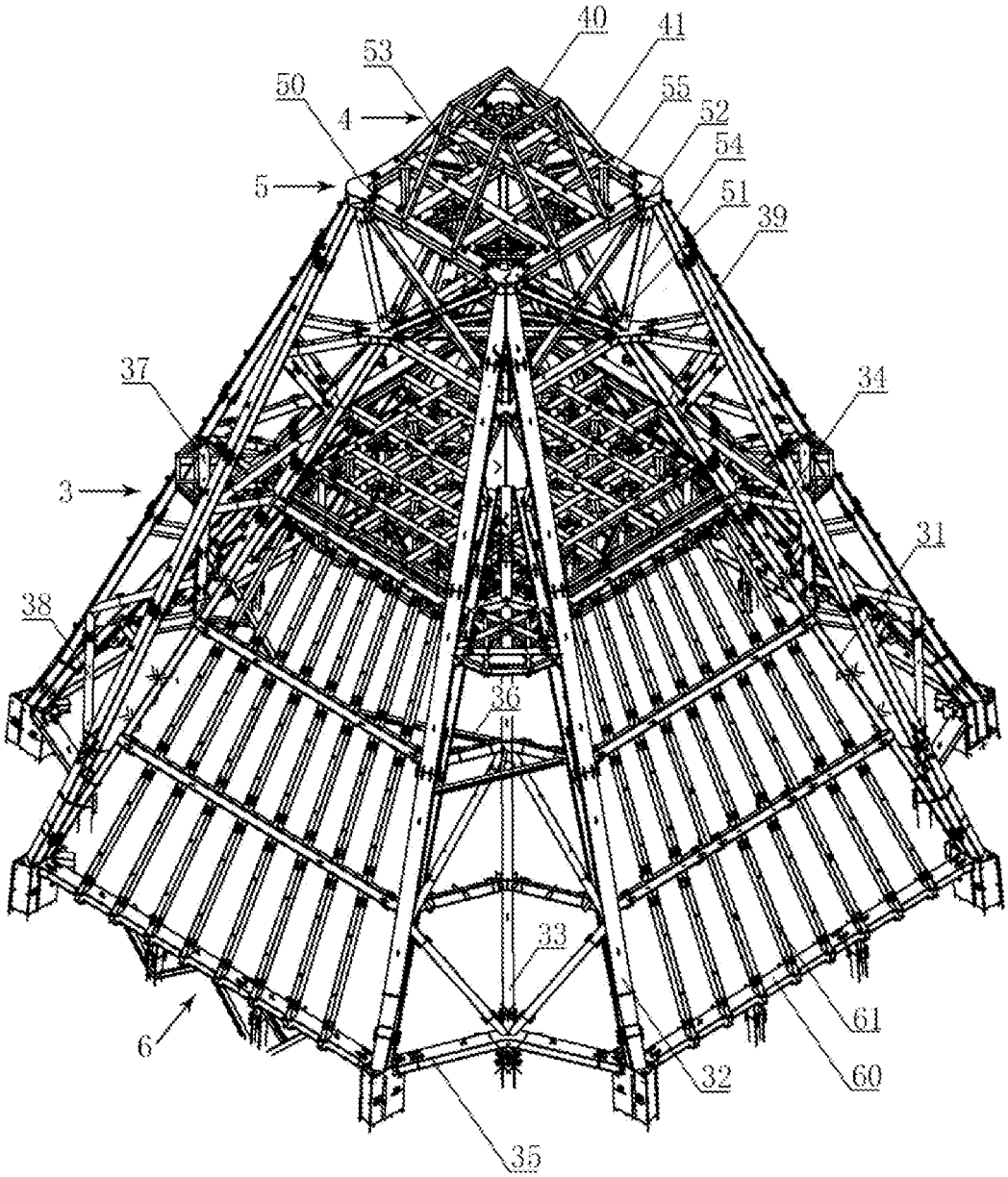
FIG. 5 is a structural schematic diagram of the installed large-angle sloping roof of the present invention.

This embodiment is shown in FIG. 5. A large-angle sloping roof steel structure connected to a main body structure, including: an intermediate platform 2, inclined main supporting steel columns 3 circumferentially connected at four corners of the intermediate platform, constructing steel columns 4 and wind-proof surrounding beam 5 connected between top ends of the inclined main supporting steel columns 3, where roof purlins 6 are connected between the adjacent inclined main supporting steel columns 3 at intervals.

Figure 2:
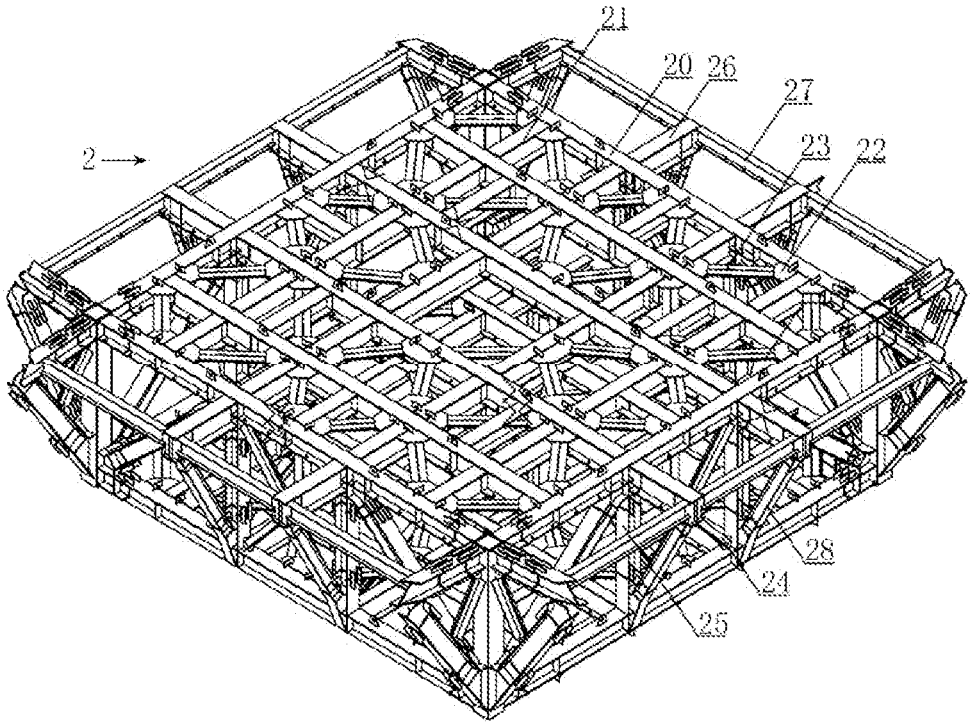
FIG. 2 is a schematic structural diagram of the intermediate platform of the present invention.

As shown in FIG. 2, the main body of the intermediate platform 2 is a double-layer grid frame, and includes an upper rectangular grid frame and a lower rectangular grid frame arranged in parallel at intervals, and vertical connecting bars 25 and oblique connecting bars 24 connected between the upper rectangular grid frame and the lower rectangular grid frame, where a lateral side of the upper rectangular grid frame is connected with a side bar 27 parallel to the lateral side through a horizontal connecting bar 26, and where a first diagonal supporting bar 28 is connected between the side bar 27 and a lateral side of the lower rectangular grid frame; the four corners of the intermediate platform 2 form conical grooves, where an end point of the side bar 27 is an external convex point, and an end point of the lateral side of the upper rectangular grid frame is an internal concave point.

The upper rectangular grid frame and the lower rectangular grid frame of the intermediate platform 2 have the same structures, and are rectangular grid-like frame bodies assembled by cross bars 20 and longitudinal bars 21; where the cross bars 20 and the longitudinal bars 21 are made of section steel, a set of cross bars are uniformly distributed in parallel at intervals, and the longitudinal bars are connected between the cross bars in parallel at intervals; at least one horizontal diagonal bar 23 is horizontally connected in a grid of the upper rectangular grid frame and/or the lower rectangular grid frame; two ends of the horizontal diagonal bar 23 are connected with the corresponding cross bars and/or longitudinal bars through horizontal lug plate 22.

Each node position of the above intermediate platform is connected by welding, and a reinforcing plate is additionally arranged at a welding position to strengthen the strength of the node position, where the node position includes the connection position between members, the connection position of bar butt joint and the like, and the connection between the members can be connected by connecting lug plates or directly welded.

As shown in FIG. 5, the wind-proof surrounding beam 5 is an inverted square frustum frame structure and includes an upper wind-proof surrounding beam 50, a lower wind-proof surrounding beam 51 and a third connecting bar 54 connected between the corners of the upper wind-proof surrounding beam 50 and the lower wind-proof surrounding beam 51; a cross-shaped bracket 53 is horizontally connected in the frame of the upper wind-proof surrounding beam 50, where a horizontal reinforcing bar 55 is connected in the grid of the cross-shaped bracket 53; cross supporting bars 52 are connected between four sides of the wind-proof surrounding beam 5 and the adjacent third connecting bar 54.

Cross supporting bars or cross-shaped brackets horizontally connected in the frame of the lower wind-proof surrounding beam 51 further enhance the structural strength.

Each node position of the above wind-proof surrounding beam 5 is connected by welding, and a reinforcing plate is additionally arranged at the welding position to strengthen the strength of the node position, where the node position includes the connection position between members, the connection position of bar butt joint and the like, and the connection between the members can be connected by connecting lug plates or directly welded.

The constructing steel column 4 includes a square frame 40 arranged in parallel above the upper wind-proof surrounding beam 50 and a third diagonal supporting bar 41 connected between the square frame 40 and the upper wind-proof surrounding beam 50; there are eight third diagonal supporting bar 41 in a radiating shape, where one end of the third diagonal supporting bar is connected to a corner of the square frame 40, and the other end of the third diagonal supporting bar is connected to an intersection point of the cross-shaped bracket 53 and the upper wind-proof surrounding beam 50.

Each node position of the above constructing steel column 4 is connected by welding, and a reinforcing plate is additionally arranged at the welding position to strengthen the strength of the node position, where the node position includes the connection position between members, the connection position of bar butt joint and the like, and the connection between the members can be connected by connecting lug plates or directly welded.

The inclined main supporting steel column 3 is a spatial three-dimensional structure, and includes two planar triangular trusses 30 and an intermediate inclined chord 33 positioned between the two triangular trusses 30, where the middle part of the triangular trusses 30 is supported at the external convex point of the intermediate platform, and the middle part of the intermediate inclined chord 33 is supported at the internal concave point of the intermediate platform 2.

The triangular trusses 30 of the inclined main supporting steel columns 3 includes an inner chord 31, an outer chord 32 and a web member 34 connected between the inner chord 31 and the outer chord 32; top ends of the two inner chord 31 and the intermediate inclined chord 33 converge at a corner of the lower wind-proof surrounding beam 51; top ends of the two outer chord 32 converge at a corner of the upper wind-proof surrounding beam 50, and a second connecting bar 39 is horizontally connected between the outer chord 32 and a corner of the lower wind-proof surrounding beam 51.

A plane supporting frame 37 is connected among the inner chord 31, the outer chord 32 and the intermediate inclined chord 33 of the inclined main supporting steel columns 3; the plane supporting frame 37 is a horizontal frame and is located at a conical groove position of the intermediate platform.

A first connecting bar 35 is horizontally connected between the intermediate inclined chord 33 and the inner chord 31, a second diagonal supporting bar 38 is connected between the intermediate inclined chord and the outer chord 32, and a horizontal diagonal supporting bar 36 is connected between the intermediate inclined chord and the roof purlin 6.

Each node position of the above inclined main supporting steel column 3 is connected by welding, and a reinforcing plate is additionally arranged at the welding position to strengthen the strength of the node position, where the node position includes the connection position between members, the connection position of bar butt joint and the like, and the connection between the members can be connected by connecting lug plates or directly welded.

The roof purlin 6 includes a set of transverse purlins 60 connected between the inner chords 31 in parallel at intervals and a set of longitudinal purlins 61 connected between the transverse purlins 60.

Each node position of the above roof purlin 6 is connected by welding, and a reinforcing plate is additionally arranged at the welding position to strengthen the strength of the node position, where the node position includes the connection position between members, the connection position of bar butt joint and the like, and the connection between the members can be connected by connecting lug plates or directly welded.

Figure 3:
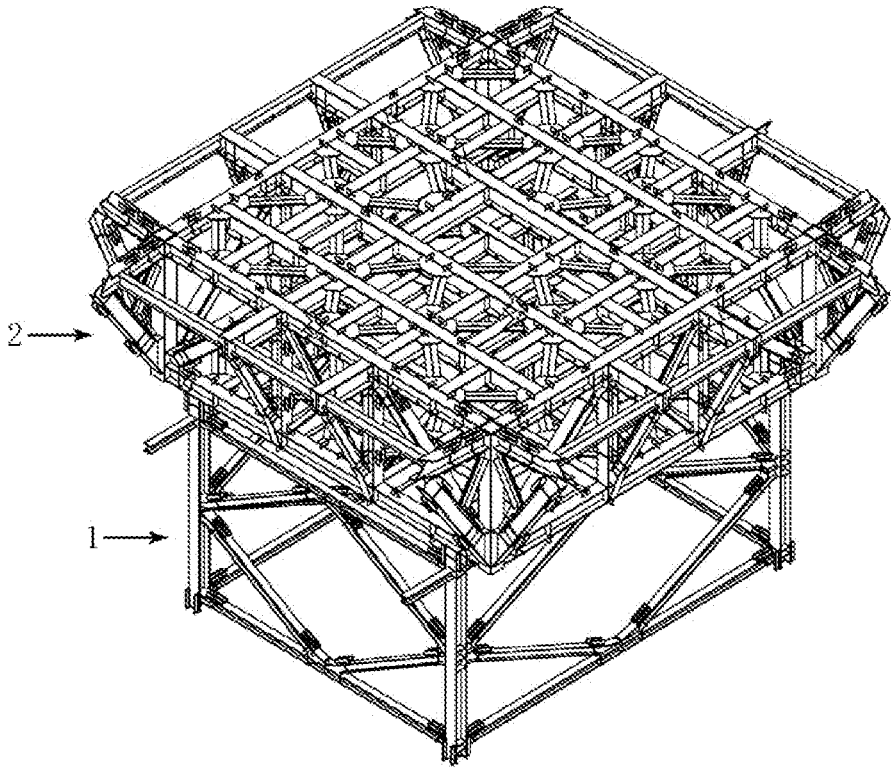
FIG. 3 is a structural schematic diagram of the installed intermediate platform of the present invention.
Figure 4:
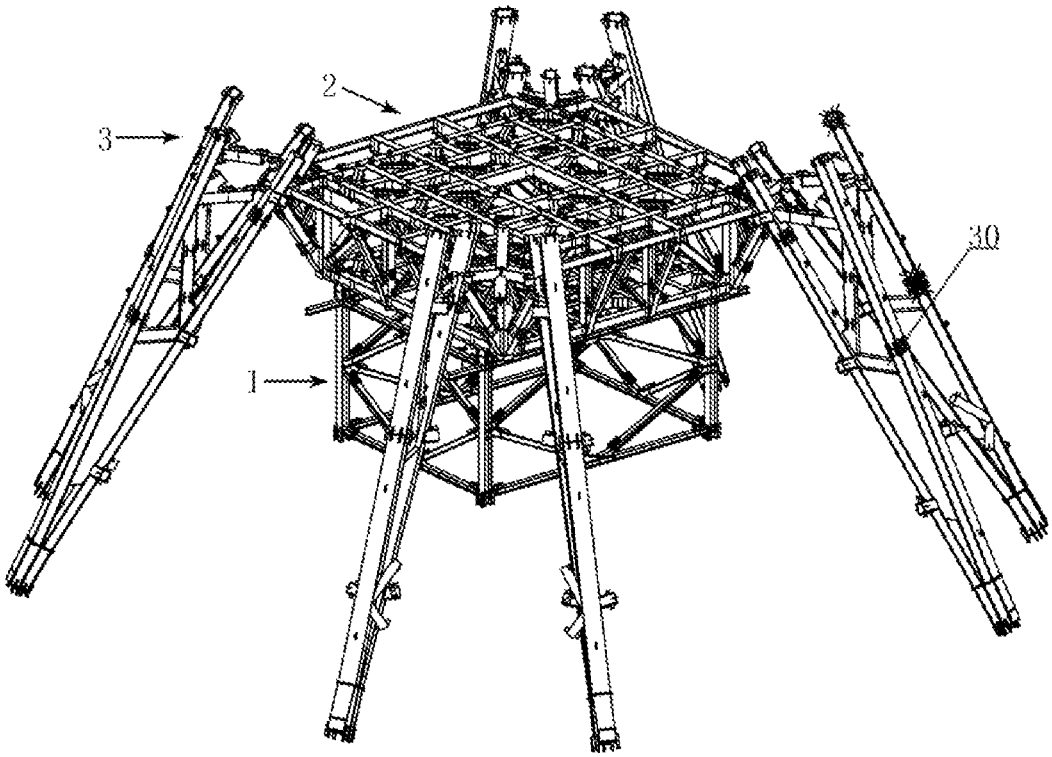
FIG. 4 is a schematic structural diagram of the installed inclined main supporting steel column of the present invention.

A construction method for a large-angle sloping roof steel structure as described, including the following specific steps:

step 1: reserving a supporting embedded part and/or a fastener for constructing a large-angle sloping roof steel structure during the construction of a main body structure.

step 2: installing a temporary frame support 1 on the main body structure.

step 3: as shown in FIG. 3, installing an intermediate platform 2 on the temporary frame support 1.

step 4: as shown in FIG. 4, connecting an inclined main supporting steel column 3 at a corner of the intermediate platform 2.

step 5: connecting a wind-proof surrounding beam 5 at the top of the inclined main supporting steel columns 3.

step 6: connecting a constructing steel column 4 above the wind-proof surrounding beam 5.

step 7: connecting a roof purlin 6 between the inclined main supporting steel columns 3.

step 8: as shown in FIG. 5, removing the temporary supporting frame 1 and completing the construction of the large-angle sloping roof steel structure.

As shown in FIG. 1, in the above step 2, the temporary frame support 1 is a three-dimensional frame structure and includes at least four upright post 10 and a cross beam 13 horizontally connected between the upper and lower ends of the adjacent upright posts; the lower end of the upright post 10 is connected with the main body structure through a supporting embedded part 14, and the upper end is provided with a limit mast 15 connecting to the intermediate platform; the four limit masts 15 are provided in a group, are arranged at the top of the upright posts symmetrically and are limited at both sides of a lateral side of a lower rectangular grid frame of the intermediate platform; four diagonal supporting bar 11 are connected in a rectangular frame enclosed by the upright post 10 and the cross beam 13, where the diagonal supporting bar 11 are spliced into a diamond shape, and the ends of the diagonal supporting bars are connected with the corresponding upright post 10 or the cross beam 13 through diagonal supporting bar connecting plate 12.

Each node position of the above temporary frame support 1 is connected by welding, and a reinforcing plate is additionally arranged at the welding position to strengthen the strength of the node position, where the node position includes the connection position between members, the connection position of bar butt joint and the like, and the connection between the members can be connected by connecting lug plates or directly welded, where the columns, cross beams and diagonal supporting bars are all H-shaped steel, and reinforcing ribs are connected between flange plates and at the connection node positions to ensure the connection strength.

The invention claimed is:

1. A large-angle sloping roof steel structure connected to a main body structure, comprising: an intermediate platform (2), inclined main supporting steel columns (3) circumferentially connected at four corners of the intermediate platform, tectonic steel columns (4) and wind-proof surrounding beams (5) connected between top ends of the inclined main supporting steel columns (3), wherein roof purlins (6) are connected between the adjacent inclined main supporting steel columns (3) at intervals;

a main body of the intermediate platform (2) is a double-layer grid frame, and comprises an upper rectangular grid frame and a lower rectangular grid frame arranged in parallel at intervals, and vertical connecting bars (25) and oblique connecting bars (24) connected between the upper rectangular grid frame and the lower rectangular grid frame, wherein a lateral side of the upper rectangular grid frame is connected with a side bar (27) parallel to the lateral side through a horizontal connecting bar (26), and wherein a first diagonal supporting bar (28) is connected between the side bar (27) and a lateral side of the lower rectangular grid frame;

the four corners of the intermediate platform (2) form conical grooves, wherein an end point of the side bar (27) is an external convex point, and an end point of the lateral side of the upper rectangular grid frame is an internal concave point;

the inclined main supporting steel column (3) is a spatial three-dimensional structure, and comprises two planar triangular trusses (30) and an intermediate inclined chord (33) positioned between the two triangular trusses (30), wherein the middle part of the triangular truss (30) is supported at the external convex point of the intermediate platform, and the middle part of the intermediate inclined chord (33) is supported at the internal concave point of the intermediate platform (2).

2. The large-angle sloping roof steel structure according to claim 1, wherein the upper rectangular grid frame and the lower rectangular grid frame of the intermediate platform (2) have the same structures, and are rectangular grid-like frame bodies assembled by cross bars (20) and longitudinal bars (21);

wherein the cross bars (20) and the longitudinal bars (21) are made of section steel, a set of cross bars are uniformly distributed in parallel at intervals, and the longitudinal bars are connected between the cross bars in parallel at intervals;

at least one horizontal diagonal bar (23) is horizontally connected in a grid of the upper rectangular grid frame and/or the lower rectangular grid frame;

two ends of the horizontal diagonal bar (23) are connected with the corresponding cross bars and/or longitudinal bars through horizontal lug plates (22).

3. The large-angle sloping roof steel structure according to claim 1, wherein the wind-proof surrounding beam (5) is an inverted square frustum frame structure and comprises an upper wind-proof surrounding beam (50), a lower wind-proof surrounding beam (51) and a third connecting bar (54) connected between the corners of the upper wind-proof surrounding beam (50) and the lower wind-proof surrounding beam (51);

a cross-shaped bracket (53) is horizontally connected in the frame of the upper wind-proof surrounding beam (50), wherein a horizontal reinforcing bar (55) is connected in the grid of the cross-shaped bracket (53);

cross supporting bars (52) are connected between four sides of the wind-proof surrounding beams (5) and the adjacent third connecting bars (54).

4. The large-angle sloping roof steel structure according to claim 3, wherein the tectonic steel column (4) comprises a square frame (40) arranged in parallel above the upper wind-proof surrounding beam (50) and a third diagonal supporting bar (41) connected between the square frame (40) and the upper wind-proof surrounding beam (50);

there are eight third diagonal supporting bars (41) in a radiating shape, wherein one end of the third diagonal supporting bar is connected to a corner of the square frame (40), and the other end of the third diagonal supporting bar is connected to an intersection point of the cross-shaped bracket (53) and the upper wind-proof surrounding beam (50).

5. The large-angle sloping roof steel structure according to claim 3, wherein the triangular truss (30) of the inclined main supporting steel column (3) comprises an inner chord (31), an outer chord (32) and a web member (34) connected between the inner chord (31) and the outer chord (32);

top ends of the two inner chords (31) and the intermediate inclined chords (33) converge at a corner of the lower wind-proof surrounding beams (51);

top ends of the two outer chords (32) converge at a corner of the upper wind-proof surrounding beams (50), and a second connecting bar (39) is horizontally connected between the outer chord (32) and a corner of the lower wind-proof surrounding beam (51).

6. The large-angle sloping roof steel structure according to claim 5, wherein a plane supporting frame (37) is connected among the inner chord (31), the outer chord (32) and the intermediate inclined chord (33) of the inclined main supporting steel column (3);

the plane supporting frame (37) is a horizontal frame and is located at a conical groove position of the intermediate platform.

7. The large-angle sloping roof steel structure according to claim 5, wherein a first connecting bar (35) is horizontally connected between the intermediate inclined chord (33) and the inner chord (31), a second diagonal supporting bar (38) is connected between the intermediate inclined chord (33) and the outer chord (32), and a horizontal diagonal supporting bar (36) is connected between the intermediate inclined chord (33) and the roof purlin (6).

8. The large-angle sloping roof steel structure according to claim 7, wherein the roof purlin (6) comprises a set of transverse purlins (60) connected between the inner chords (31) in parallel at intervals and a set of longitudinal purlins (61) connected between the transverse purlins (60).

9. A construction method for a large-angle sloping roof steel structure according to claim 1, wherein the specific steps are as follows:

step 1: reserving a supporting embedded part and/or a fastener for constructing a large□ angle sloping roof steel structure during the construction of a main body structure;

step 2: installing a temporary frame support (1) on the main body structure;

step 3: installing an intermediate platform (2) on the temporary frame support (1);

step 4: connecting an inclined main supporting steel column (3) at a corner of the intermediate platform (2);

step 5: connecting a wind-proof surrounding beam (5) at the top of the inclined main supporting steel column (3);

step 6: connecting a tectonic steel column (4) above the wind-proof surrounding beam (5);

step 7: connecting a roof purlin (6) between the inclined main supporting steel columns (3);

step 8: removing the temporary supporting frame (1) and completing the construction of the large-angle sloping roof steel structure.

10. The construction method for a large-angle sloping roof steel structure according to claim 9, wherein in the step 2, the temporary frame support (1) is a three-dimensional frame structure and comprises at least four upright posts (10) and a cross beam (13) horizontally connected between the upper and lower ends of the adjacent upright posts;

the lower end of the upright post (10) is connected with the main body structure through a supporting embedded part (14), and the upper end is provided with a limit mast (15) connecting to the intermediate platform;

the four limit masts (15) are provided in a group, are arranged at the top of the upright posts symmetrically and are limited at both sides of a lateral side of a lower rectangular grid frame of the intermediate platform;

four diagonal supporting bars (11) are connected in a rectangular frame enclosed by the upright posts (10) and the cross beams (13), wherein the diagonal supporting bars (11) are spliced into a diamond shape, and the ends of the diagonal supporting bars are connected with the corresponding upright posts (10) or the cross beams (13) through diagonal supporting bar connecting plates (12).

* * * * *